US006729510B1

(12) United States Patent
Romanov

(10) Patent No.: US 6,729,510 B1
(45) Date of Patent: May 4, 2004

(54) HAND PROTECTION DEVICE

(76) Inventor: Natasha Romanov, 6 George St., Apartment 22, Pawtucket, RI (US) 02860

( * ) Notice: Subject to any disclaimer, the term of this patent is extended or adjusted under 35 U.S.C. 154(b) by 0 days.

(21) Appl. No.: 10/352,900

(22) Filed: Jan. 29, 2003

(51) Int. Cl.[7] ..... A42C 1/08
(52) U.S. Cl. ..... 223/101; 2/21
(58) Field of Search ..... 223/101; 2/21, 2/16; 30/298, 295; D29/113, 114

(56) References Cited

U.S. PATENT DOCUMENTS

| | | | | | |
|---|---|---|---|---|---|
| 474,237 | A | | 5/1892 | Frost | |
| 1,184,710 | A | | 5/1916 | Baumann | |
| 2,149,922 | A | | 3/1939 | Lemire | |
| 2,448,697 | A | | 9/1948 | Bakke | |
| 2,501,571 | A | | 3/1950 | Liedtke | |
| 2,811,767 | A | | 11/1957 | Dufford | |
| 3,074,399 | A | | 1/1963 | Bitting | |
| 4,127,222 | A | | 11/1978 | Adams | |
| 4,460,113 | A | * | 7/1984 | Nicklous | 223/101 |
| 4,507,804 | A | | 4/1985 | Consigny | |
| 4,694,843 | A | | 9/1987 | Casenhiser | |
| D351,257 | S | * | 10/1994 | Roberts et al. | D29/113 |
| 5,363,508 | A | | 11/1994 | Kim | |
| 5,450,626 | A | | 9/1995 | Sorrels | |
| 5,485,856 | A | | 1/1996 | Buckland | |
| 5,575,296 | A | * | 11/1996 | Peck | 128/880 |
| 5,647,063 | A | | 7/1997 | Bates | |
| 5,711,027 | A | | 1/1998 | Katz et al. | |
| D391,029 | S | | 2/1998 | Katz et al. | |
| 5,842,227 | A | | 12/1998 | Rabin et al. | |
| D414,300 | S | * | 9/1999 | Silvey | D29/114 |
| D415,321 | S | | 10/1999 | Silvey | |
| D418,258 | S | | 12/1999 | Moro | |
| 6,237,148 | B1 | * | 5/2001 | Graham | 2/21 |
| 6,409,059 | B1 | | 6/2002 | Calvert | |

FOREIGN PATENT DOCUMENTS

| | | |
|---|---|---|
| EP | 0 124 148 A1 | 11/1984 |
| GB | 2183990 A | 6/1987 |

* cited by examiner

*Primary Examiner*—John J. Calvert
*Assistant Examiner*—James G Smith
(74) *Attorney, Agent, or Firm*—Barlow, Josephs & Holmes, Ltd.

(57) ABSTRACT

The hand protection device protects the fingers of a hand used to hold a workpiece while a second hand operates a sharp instrument to cut or stab the workpiece. The device forms a shield composed of a thin sheet of material having a width adapted to extend across all four fingers of the hand, and a height adapted to extend for approximately the length of the distal two phalanges and a portion of the proximal phalange. The top portion of the shield is bent or curved to form a lip over the interphalangeal joint between the first (proximal) and second (middle) rows of phalanges. The bottom portion of the shield is bent or curved at about a 45° angle to protect the third (distal) row of phalanges. The device includes a hollow, substantially cylindrical holder for receiving the middle phalange of one finger.

15 Claims, 6 Drawing Sheets

HAND PROTECTION DEVICE

BACKGROUND OF THE INVENTION

1. Field of the Invention

The present invention is directed to a hand protection device for protecting the fingers of a hand while working with knives, cutting tools, needles, or other sharp instruments. While not limited to any particular application, the hand protection device is particularly effective as a shield for protecting the fingers of a hand holding food while a second hand cuts or prepares the food with a sharp implement, such as a knife, cleaver, chopper, or other sharp tool.

2. Description of the Related Art

Safety is a matter of concern when using cutting implements, e.g., when preparing food or cutting a piece of wood with a sharp implement. Protection against stab wounds is likewise a matter of concern when using needles, awls, hooks, or other sharp implements while sewing, working with leather, fishing lines, etc. It is well known that a sharp tool, such a sharp kitchen knife, presents a hazard to a person's hands and fingers. For example, an accident with a knife can cause a serious injury to the tendons of a finger. A routine cooking task such as slicing up a carrot can lead to nasty wounds to more than one finger of a person's hand. Even experienced cooks can suffer serious cuts to their hands, or to the fingers of a hand, from a sharp slicing knife while preparing food. Likewise metal and wood workers can suffer serious injury to an unprotected hand when using a sharp tool.

Various hand and finger protection devices are available. Although such devices do provide adequate protection, quite often they are cumbersome to use. Other devices are less cumbersome to use, but provide only partial protection to the fingers of a hand, e.g. protecting just the finger tips. Thus, what is needed is a protective shield that adequately protects the fingers of a hand without unduly interfering with the task of cutting or slicing meat, vegetables, and the like. The protective shield should be suitable for use with small and large cutting or slicing knives.

A metal finger shield is provided by the Meilleur du Chef Club™ (hereinafter the "MDC shield"), as shown on a web page published Jan. 20, 2003 at www.meilleurduchef.com/cgi/mdc/1/en/boutique/produits/petit_mal/ess-digiclass.html. The MDC shield has an adjustable ring attached to the rear face of a metal shield. The MDC shield at best only protects the finger tips. The MDC shield attaches only to the middle finger. In addition, the MDC shield is designed to work best with small utensils.

Other efforts have been made to address such problems. U.S. Pat. No. Des. 351,257 (Roberts et al.) shows an ornamental design for a finger shield for use while cutting and dicing food. The '257 shield. comprises two rings attached to the rear of the shield which makes it cumbersome to use.

U.S. Pat. No. 5,711,027 (Katz et al.) describes a hand and finger shield comprising a front and rear wall, and at least one intermediate wall. A user obtains protection from a cutting or dicing knife when the fingers are placed on either side of the intermediate wall, and between the front and rear walls. The '027 shield is cumbersome to use because a user can't easily use his fingers to hold the food being cut or diced.

Other patents showing shields and the like, but which do not suggest a hand protection device according to the claimed invention, include the following U.S. Patents: Des. Pat. No. 391,029 (Katz et al.), Des. Pat. No. 414,300 (Silvey), Des. Pat. No. 415,321 (Silvey), Des. Pat. No. 418,258 (Moro), U.S. Pat. No. 474,237 (Frost), U.S. Pat. No. 1,184,710 (Baumann), U.S. Pat. No. 2,149,922 (Lemire), U.S. Pat. No. 2,488,697 (Bakke), U.S. Pat. No. 2,501,571 (Liedtke), U.S. Pat. No. 2,811,767 (Dufford), U.S. Pat. No. 3,074,399 (Bitting), U.S. Pat. No. 4,127,222 (Adams), U.S. Pat. No. 4,460,113 (Nicklous), U.S. Pat. No. 4,507,804 (Consigny), U.S. Pat. No. 4,694,843 (Casenhiser), U.S. Pat. No. 5,363,508 (Kim), U.S. Pat. No. 5,450,626 (Sorrels), U.S. Pat. No. 5,485,856 (Buckland), U.S. Pat. No. 5,575,296 (Peck), U.S. Pat. No. 5,647,063 (Bates), U.S. Pat. No. 5,711,027 (Katz et al.), U.S. Pat. No. 5,842,227 (Rabin et al.), U.S. Pat. No. 6,237,148 B1 (Graham), and U.S. Pat. No. 6,409,059 (Calvert).

Foreign patents showing shields and the like, but which do not suggest a hand protection device according to the claimed invention, include European Patent No. 124,148 and United Kingdom Patent No. 2,183,990.

None of the above inventions and patents, taken either singly or in combination, is seen to describe the instant invention as claimed. Thus a hand protection device solving the aforementioned problems is desired.

SUMMARY OF THE INVENTION

The present invention is a hand protection device for protecting the fingers of a hand used to hold a workpiece while a second hand operates a sharp instrument to cut or stab the workpiece. The device forms a shield composed of a thin sheet of material having a width adapted to extend across all four fingers of the hand, and a height adapted to extend for approximately the length of the distal two phalanges and a portion of the proximal phalange. The top portion of the shield is bent or curved to form a lip over the interphalangeal joint between the first (proximal) and second (middle) rows of phalanges. The bottom portion of the shield is bent or curved at about a 45° angle to protect the third (distal) row of phalanges. The device includes a hollow, substantially cylindrical holder or saddle having an axial slot defined therein for receiving the middle phalange of one finger.

The distance between the top portion and the bottom portion of the shield is slightly greater than the length of the middle phalange, but less than the combined length of the middle and distal phalanges. Since the width of the shield extends across the width of the four fingers (the index finger through the little finger), when the middle phalange of the index or middle finger is inserted through the holder, all of the four fingers flex at the interphalangeal joint between the middle and distal phalanges, the shield being interposed between the knife and the fingers. Protection of the interphalangeal joint between the proximal and middle phalanges is provided by the top portion of the shield. The bottom portion of the shield may be generally triangular in shape, the bottom edge extending farther downward and rearward at the middle than at the opposing sides of the shield in order to accommodate the greater length of the middle finger.

Accordingly, it is an object of the invention to prevent injuries to the fingers of one hand holding a workpiece while the other hand manipulates a sharp instrument to cut, stab, chop, cleave, or otherwise shape the workpiece.

It is another object of the invention to provide a protection device that is not limited to protecting only the finger tips of a hand.

It is a further object of the invention to provide a protection device that can be attached to a single finger, but which protects all four fingers of the hand from injuries caused by manipulation of a knife or other sharp implement.

It is another object of the invention to allow an inexperienced cook to quickly slice food without fear of serious injury to the fingers of the non-knife holding hand.

It is yet another object of the invention to provide a shield which acts as a guide for controlling the up and down movement of a cutting knife.

It is an object of the invention to provide improved elements and arrangements thereof for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
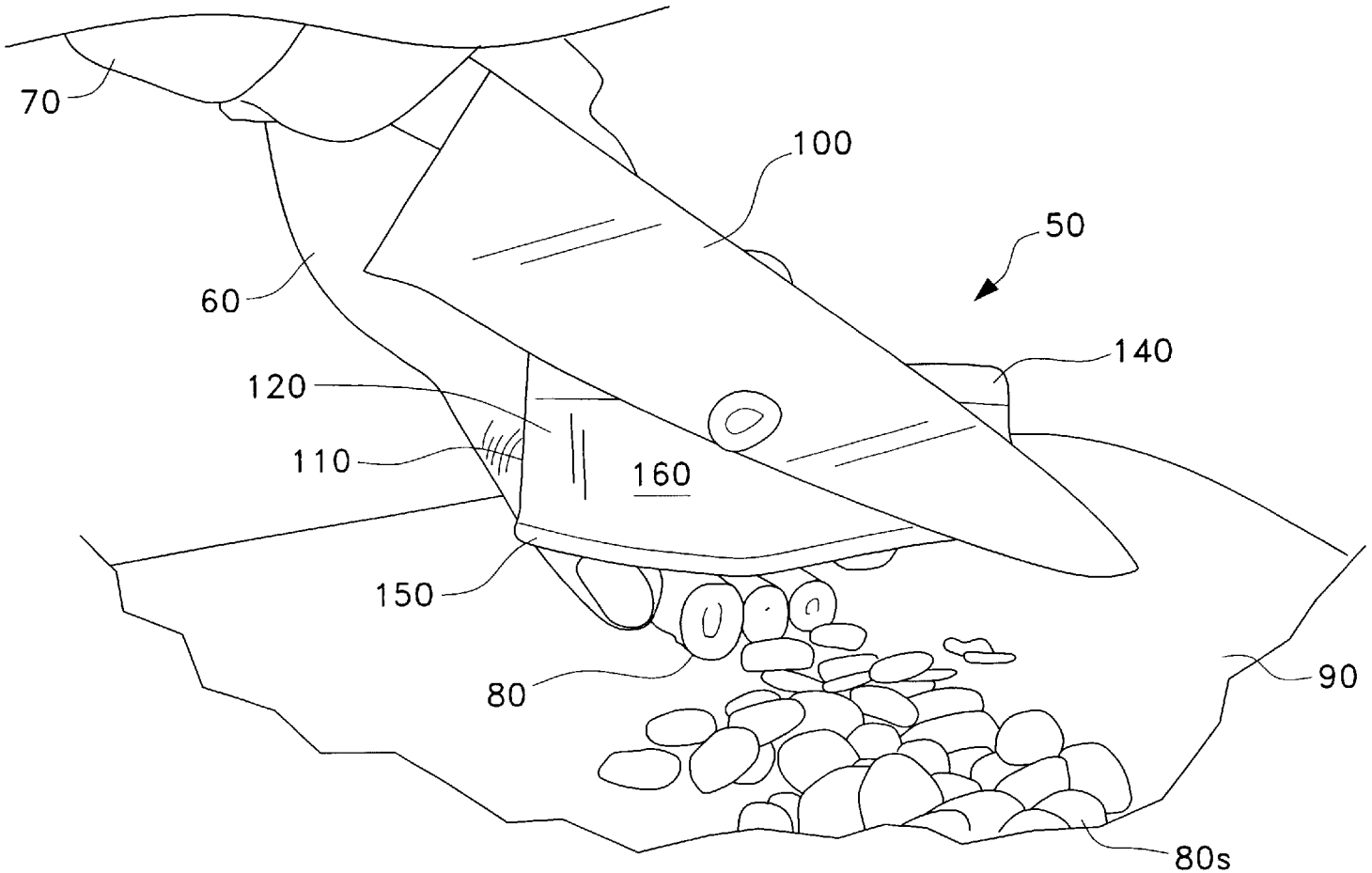
FIG. 1 is an environmental, front perspective view of a hand protection device according to the invention, the device being used as both a shield and a guide for slicing carrots.

The present invention is directed to a hand protection device 50, shown in FIGS. 1–6. The hand protection device 50 is used for protecting the fingers 185 of a first or brace hand 60 used to brace a workpiece, while a second or cutting hand 70 wields a knife 100 or other sharp instrument used to cut, shape, or pierce the workpiece.

Figure 2:
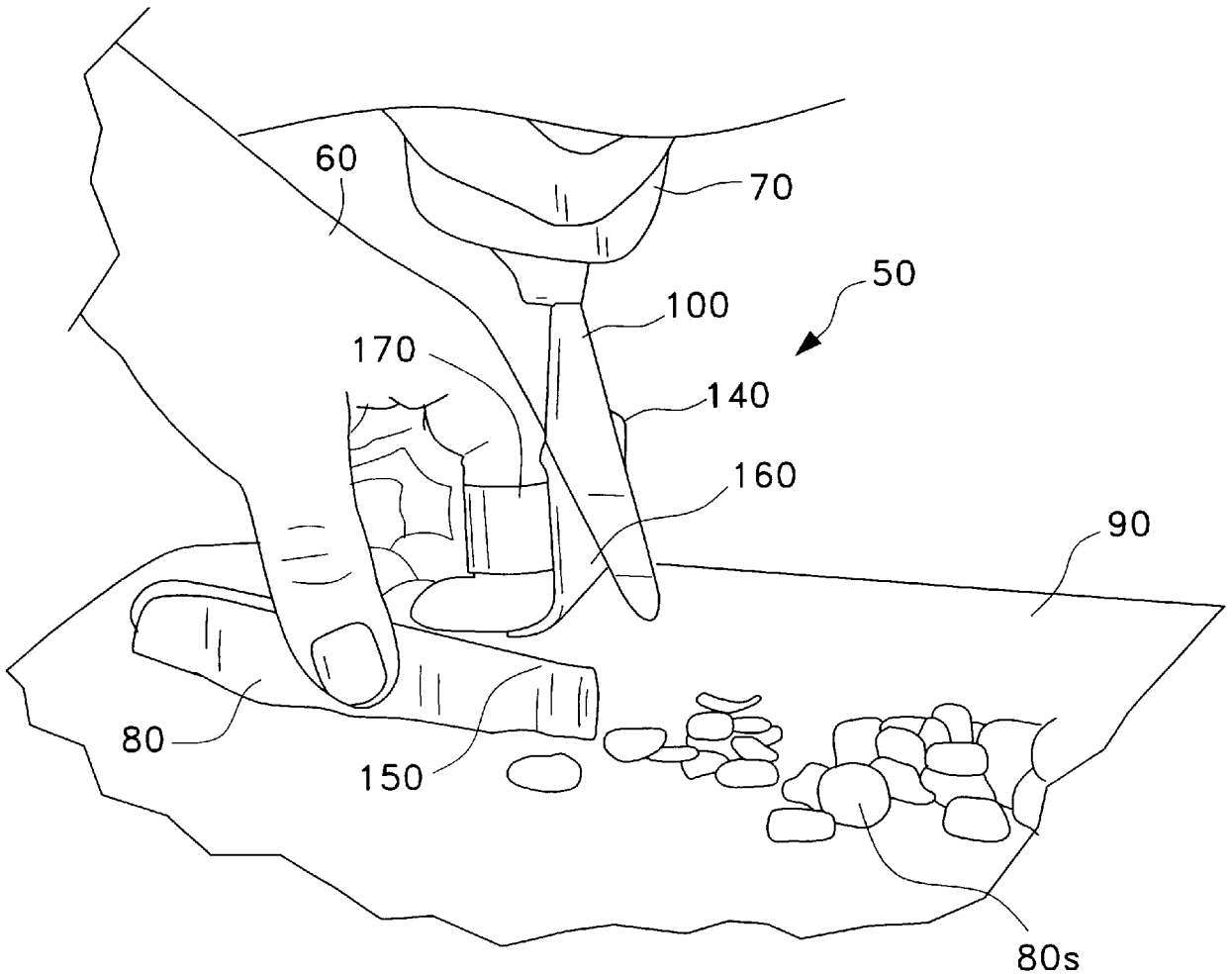
FIG. 2 is an environmental, side perspective view of the hand protection device of FIG. 1.

The hand protection device 50 according to the invention is shown in FIGS. 1–2 protecting the brace hand 60, while the second hand 70 is performing a crosscut on carrots 80 with a knife 100 to provide sliced carrots 80 on a work top 90. The hand protection device 50 is composed of a shield 110 and a holder 170.

The four fingers 185 (index, middle, ring, and little) of the human hand 60 each have a metacarpal bone and three phalanges extending from the metacarpal bone. The phalanges include a proximal phalange 210 attached to the metacarpal, a distal phalange 190 at the end of the finger 185 and forming the fingertip, and a middle phalange 200 disposed between the proximal 210 and distal phalange 190. The phalanges articulate about interphalangeal joints formed by ligaments, and can flex or extend. The thumb 220 lacks a middle phalange.

Figure 3:
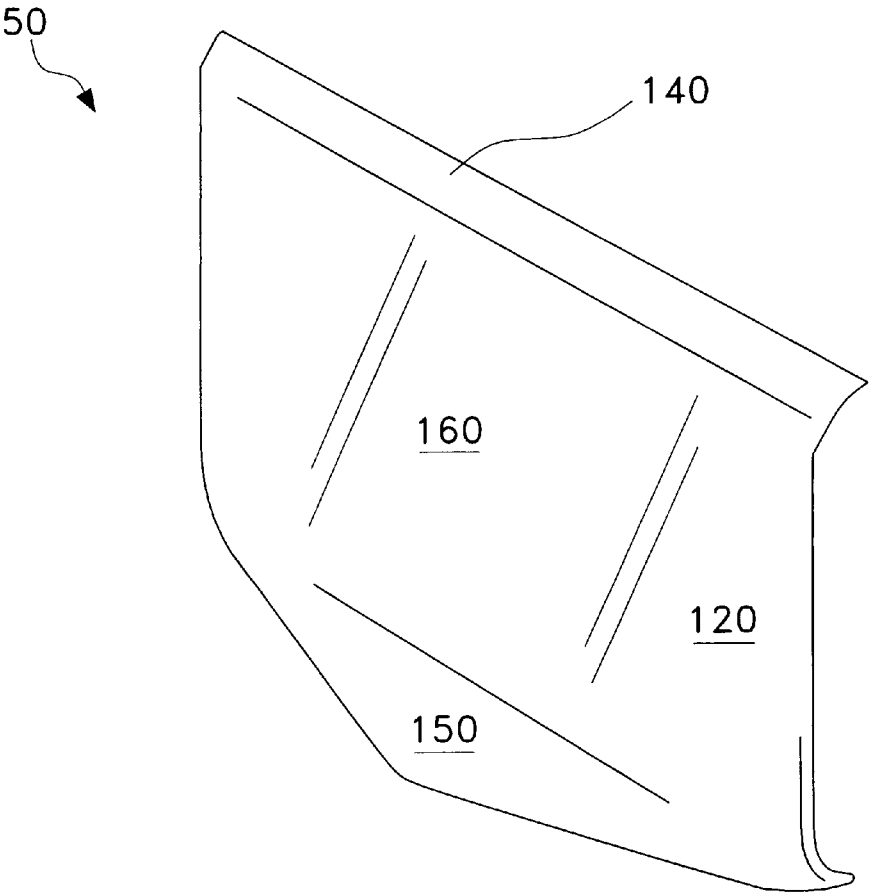
FIG. 3 is a front perspective view of the hand protection device of FIG. 1.
Figure 4:
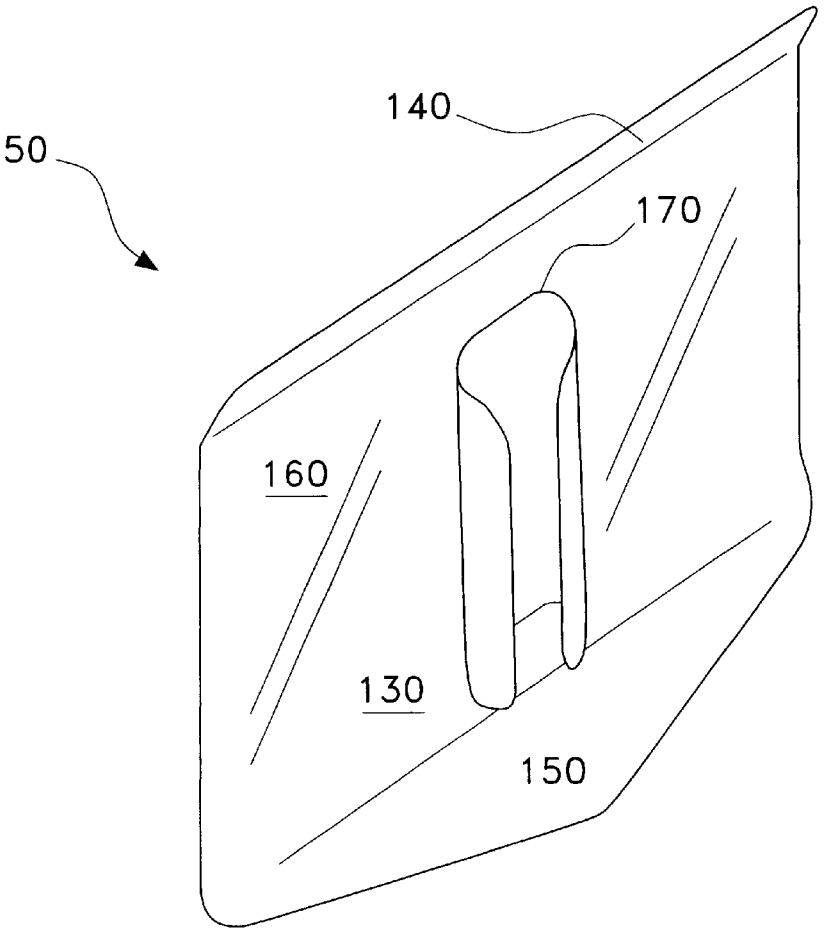
FIG. 4 is a rear perspective view of the hand protection device of FIG. 1.
Figure 5:
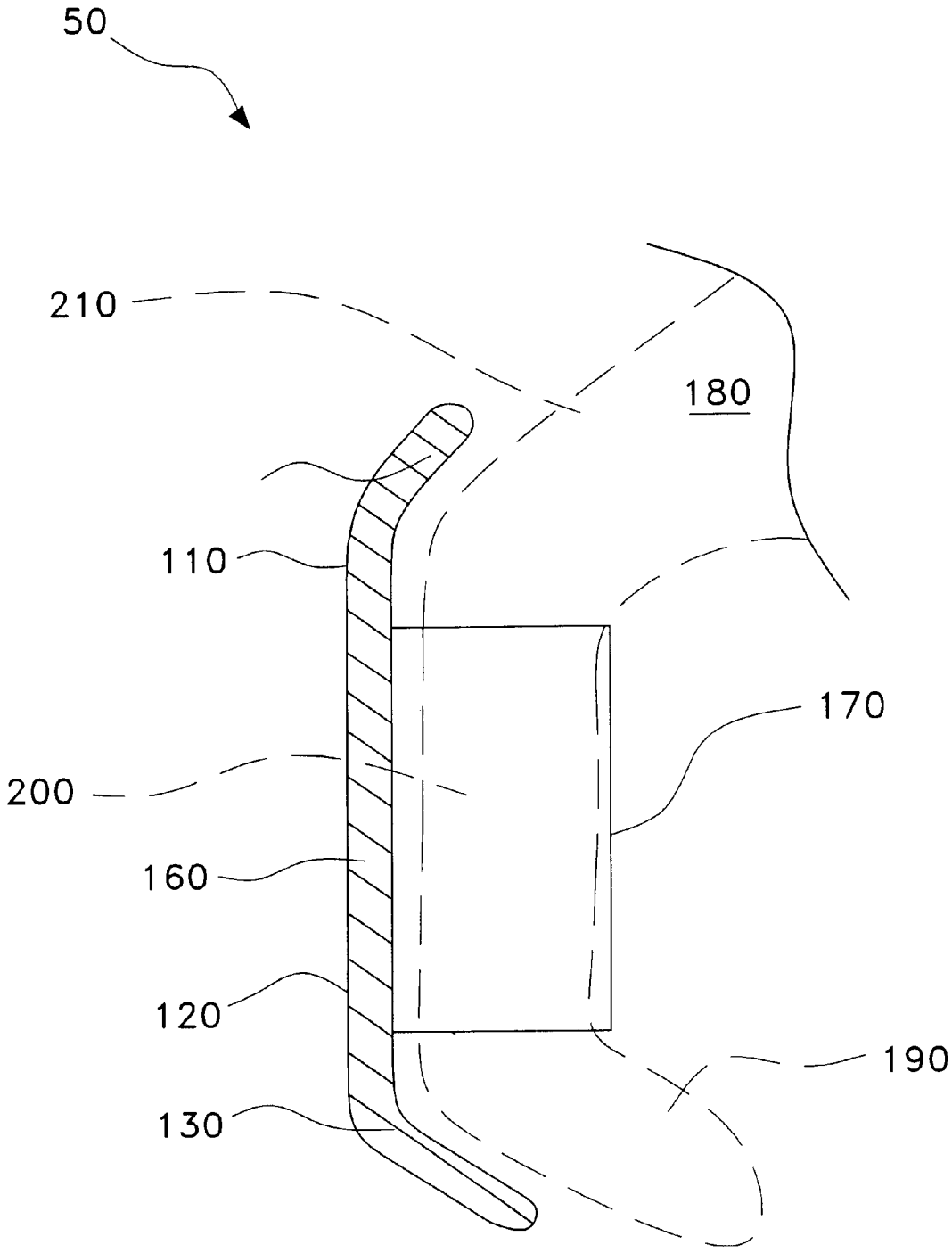
FIG. 5 is a vertical section view of the hand protection device of FIG. 1 with a middle phalange of a finger attached to a finger holder of the device, the remaining fingers being omitted for clarity.

As seen in FIGS. 3–5, the shield 110 is a rigid, thin sheet of material having a front face 120 and a rear face 130. The shield 110 has a width adapted to extend across all four fingers 185 of the brace hand 60. Typically, the width of the shield is between about three inches and six inches, although these dimensions are representative, and not intended to limit the scope of the claims. The top portion of the shield 110 is bent, curved, or canted across the width of the shield 110 towards the rear to form a lip or top guard 140 adapted to extend over the interphalangeal joint between the first (proximal) 210 and second (middle) rows 200 of phalanges. The bottom portion of the shield 110 is similarly bent, curved, or canted at about a 45° angle across the width of the shield 110 to form a bottom guard 150 which is adapted to protect the third (distal) row 190 of phalanges. Although 45° represents a preferred cant angle, it will be understood that the cant angle may vary between 30° and 90° within the scope of the present invention. The bottom guard 150 may be generally triangular in shape, the bottom edge extending farther downward and rearward at the middle than at the opposing sides of the shield 110 in order to accommodate the greater length of the middle finger.

A planar middle section 160 extends between the top guard 140 and the bottom guard 150. The height of the middle section 160 (the distance been the bends forming the top guard 140 and bottom guard 150) is slightly greater than the length of the middle phalange 200, but less than the combined length of the middle 200 and distal 190 phalanges. A typical middle section 160 height is about one inch, although it will be understood that the hand protection device 50 may be made in different sizes to accommodate fingers 185 of different lengths.

Figure 6:
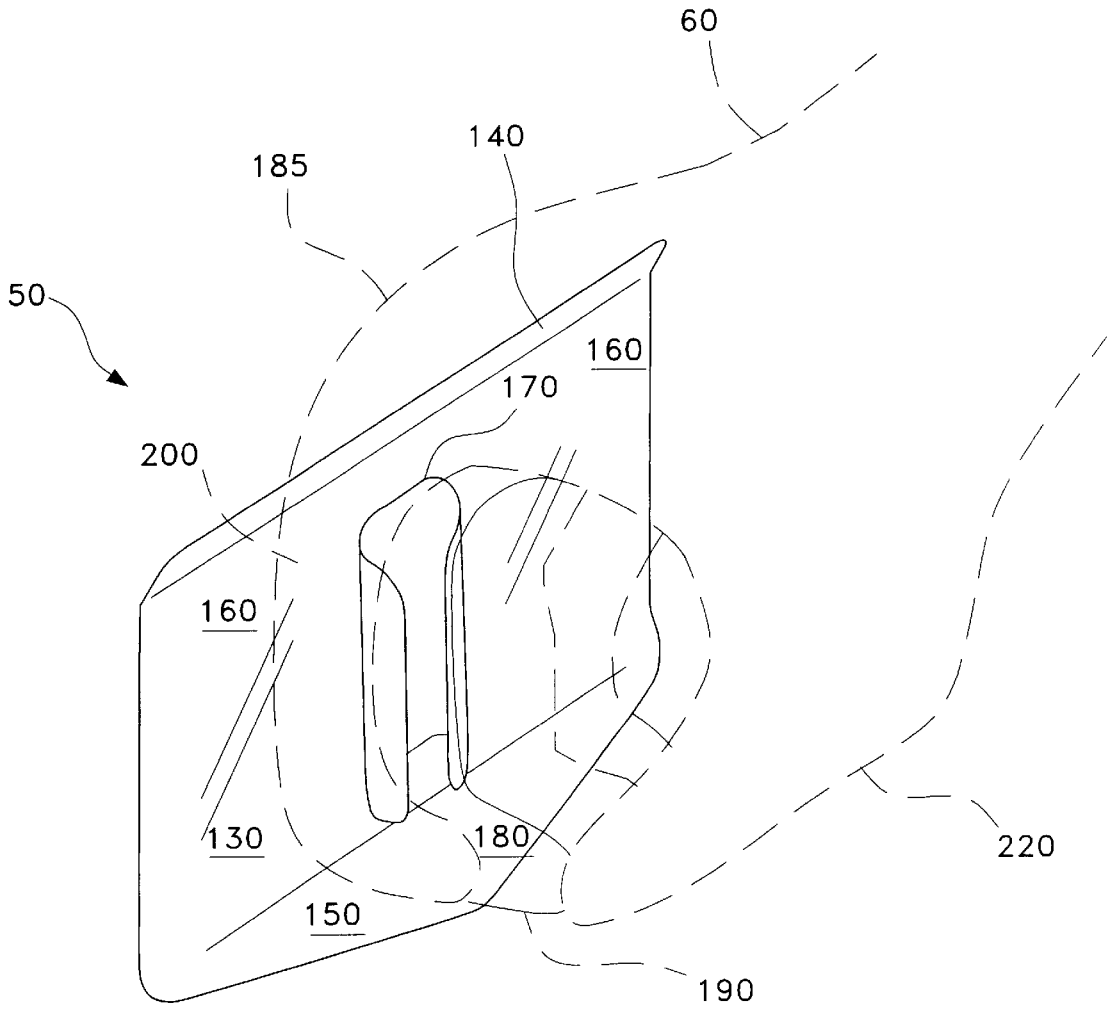
FIG. 6 is a rear view of the hand protection device of FIG. 1 showing the fingers of a hand curled behind the hand protection device.

As seen in FIGS. 4–6, the finger holder 170 is formed by a hollow cylinder attached to the rear face of the middle section 160 of the shield. The cylinder is split axially by a slot extending the height of the cylinder. Alternatively, the finger holder 170 may be formed by two arcuate, opposed, semi-cylindrical spring arms which are attached to, and spaced apart upon, the rear face of the middle section 160. Thus, the finger holder 170 forms a saddle adapted for receiving the middle phalange 200 of a finger. The finger holder 170 has sufficient flexibility and resilience that it will accommodate the middle phalange 200 of the finger 180 inserted through the holder 170 over a wide range of finger thickness. Thus, although it is preferred that the middle finger be inserted through the finger holder 170, the finger holder 170 will accommodate the index finger, ring finger, or even the little finger of most hands.

The hand protection device 50 may be made from a variety of materials. The hand protection device 50 may be made from metal, e.g., aluminum, copper, steel, particularly stainless steel, brass, or various other metal alloys, depending upon the application. Alternatively, the hand protection device 50 may be made from a lightweight, thermoplastic material, such as polyethylene, polypropylene, polystyrene, ABS, etc.

In use, a finger 180 of the brace hand 60 is inserted through the finger holder 170 so that the middle phalange 200 extends through the finger holder 170. Preferably the hand protection device 50 is retained by either the index or middle finger. With the middle phalange extending through the finger holder 170, each of the four fingers 185 (index, middle, ring and little) are forced to flex at the interphalangeal joint between the middle 200 and distal 190 phalanges, so that the fingers 185 adopt a curled conformation with the fingertips extending rearward from the middle section 160 and the bottom guard 150 interposed between the fingers 185 and the cutting implement. The width of the shield 110 and the rearward cant of the bottom guard 150 cause all four fingers 185 to curl rearward. Further, the fingers 185 also flex at the interphalangeal joint between the proximal 210 and middle 200 phalanges, the joint being protected by the top guard 140, which extends over the joint.

When the workpiece is cylindrical, such as the carrots 80 shown in FIGS. 1–2, the workpiece may be grasped between the thumb 220 and the little finger of the brace hand 60. When the workpiece is broader, such as a board or a cut of meat, the workpiece may be held solely by pressure of the brace hand 60 against the workpiece. The cutting hand 70 is used to manipulate the sharp implement. When the cutting implement is a knife 100, the flat face of the knife 100 may be placed. against the planar middle section 160, so that the hand protection device 50 can also act as a cutting guide for the knife 100. The bottom guard 150 prevents the distal phalanges 190 from extending into the cutting path of the knife 100, a common instinctive reaction when the grip of the brace hand 60 on the workpiece slips.

Although illustrated with a knife 100 cutting food, it will be appreciated that use of the hand protection device 50 is not limited to this application, but extends to any process, manual or automated, where a workpiece is held by a brace hand 60 while the cutting hand 70 manipulates any sharp implement. Thus, the hand protection device may be used when carving or cutting wood, punching holes in leather, cutting yard goods, sewing with a sewing machine, working with fish hooks and fishing lines, etc. Further, the hand protection device 50 may be retained on either the left hand or the right hand.

Thus, the hand protection device 50 provides a simple, lightweight, economical, and ergonomic device which prevents cuts, stab and piercing wounds to the fingers and hands when working with sharp implements.

It is to be understood that the present invention is not limited to the embodiments described above, but encompasses any and all embodiments within the scope of the following claims.

I claim:

1. A hand protection device for protecting a brace hand and fingers of the brace hand retaining a workpiece from injury when a cutting hand manipulates a sharp implement on the workpiece, the hand protection device comprising:

a shield made of a rigid, thin sheet of material having a front face and a rear face, and having a top edge, a bottom edge, and opposing side edges, the shield having a width extending between the opposing side edges, the shield being canted rearward across the width of the shield adjacent the top in order to form a top guard, the shield being canted rearward across the width of the shield adjacent the bottom in order to form a bottom guard, the shield having a planar middle section extending between the top guard and the bottom guard, the width of the shield being adapted for extending across the brace hand in order to cover four of the fingers of the brace hand from an index finger to a little finger; and a finger holder attached to the rear face of the middle section of the shield, the finger holder being adapted to receive a middle phalange of one of the fingers of the brace hand in order to retain the shield on the brace hand;

wherein a cant angle defined between the middle section and the bottom guard is between 30° and 90° and a cant angle defined between the middle section and the top guard is between 30° and 90° in order to cause distal and proximal phalanges of the brace hand to flex rearward when the shield is retained on the brace hand, and the planar middle section bears against middle phalanges of the brace hand causing the middle phalanges to assume a straight position.

2. The hand protection device according to claim 1, wherein the cant angle between the middle section and bottom guard is 45°.

3. The hand protection device according to claim 1, wherein the middle section extends for a distance of at least one inch between the top guard and the bottom guard in order to cover the middle phalanges of the fingers of the brace hand and to cause the bottom guard to bear against the distal phalanges to flex the distal phalanges rearward.

4. The hand protection device according to claim 1, wherein the top guard is canted rearward at an angle of about 45° relative to the middle section in order to cover interphalangeal joints between the middle phalanges and proximal phalanges of the fingers of the brace hand.

5. The hand protection device according to claim 1, wherein said shield and said finger holder are made from metal.

6. The hand protection device according to claim 1, wherein the shield and the finger holder are made from a material selected from the group consisting of aluminum, copper, and a metal alloy.

7. The hand protection device according to claim 1, wherein the shield and the finger holder are made from steel.

8. The hand protection device according to claim 1, wherein the shield and the finger holder are made from stainless steel.

9. The hand protection device according to claim 1, wherein the shield and the finger holder are made from brass.

10. The hand protection device according to claim 1, wherein the shield and the finger holder are made from a thermoplastic material.

11. The hand protection device according to claim 1, wherein the shield and the finger holder are made from a material selected from the group consisting of polyethylene, polypropylene, and polystyrene.

12. The hand protection device according to claim 1, wherein said finger holder comprises a hollow cylinder split axially to define two opposed cylinder halves attached to the rear face of said middle section.

13. The hand protection device according to claim 1, wherein said finger holder comprises a pair of opposed, arcuate, semi-cylindrical spring arms attached to and spaced apart upon the rear face of said middle section.

14. The hand protection device according to claim 1, wherein said finger holder is flexible and resilient in order to accommodate different finger thickness.

15. The hand protection device according to claim 1, wherein said bottom guard is substantially triangular, being adapted to accommodate a middle finger having a greater length than index and ring fingers.

* * * * *